United States Patent [19]

Shillander

[11] 4,256,179

[45] Mar. 17, 1981

[54] INDEXING TOOL FOR USE IN EARTH BOREHOLE DRILLING AND TESTING

[75] Inventor: Harold E. Shillander, Albuquerque, N. Mex.

[73] Assignee: International Oil Tools, Inc., Seattle, Wash.

[21] Appl. No.: 84,679

[22] Filed: Oct. 15, 1979

[51] Int. Cl.[3] ..... E21B 23/00; F16H 27/02

[52] U.S. Cl. ..... 166/237; 166/240; 285/303; 175/321

[58] Field of Search ..... 166/237, 240, 243; 175/321; 285/18, 302, 303

[56] References Cited

U.S. PATENT DOCUMENTS

| | | | |
|---|---|---|---|
| 3,082,831 | 3/1963 | Le Bus, Sr. | 166/240 |
| 3,233,676 | 2/1966 | Lynes | 166/152 |
| 3,265,135 | 8/1966 | Wilkinson | 166/240 |
| 3,578,078 | 5/1971 | Shillander | 166/152 |
| 3,703,104 | 11/1972 | Tamplen | 166/240 |

*Primary Examiner*—James A. Leppink

*Attorney, Agent, or Firm*—Walter R. Keller

[57] ABSTRACT

An index mandrel body, which connects with a well string in a borehole, is received by a tubular body have a plurality of splines, which slidably engage teeth on an indexing sleeve rigidly affixed inside the mandrel said splines receiving seatable lands rigidly affixed inside the tubular body, said lands being so spaced as to be able to pass between the splines so that the body becomes fully rotatable, said invention being adaptable for use in compression or tension application to off shore drilling, as well as on land drilling.

2 Claims, 3 Drawing Figures

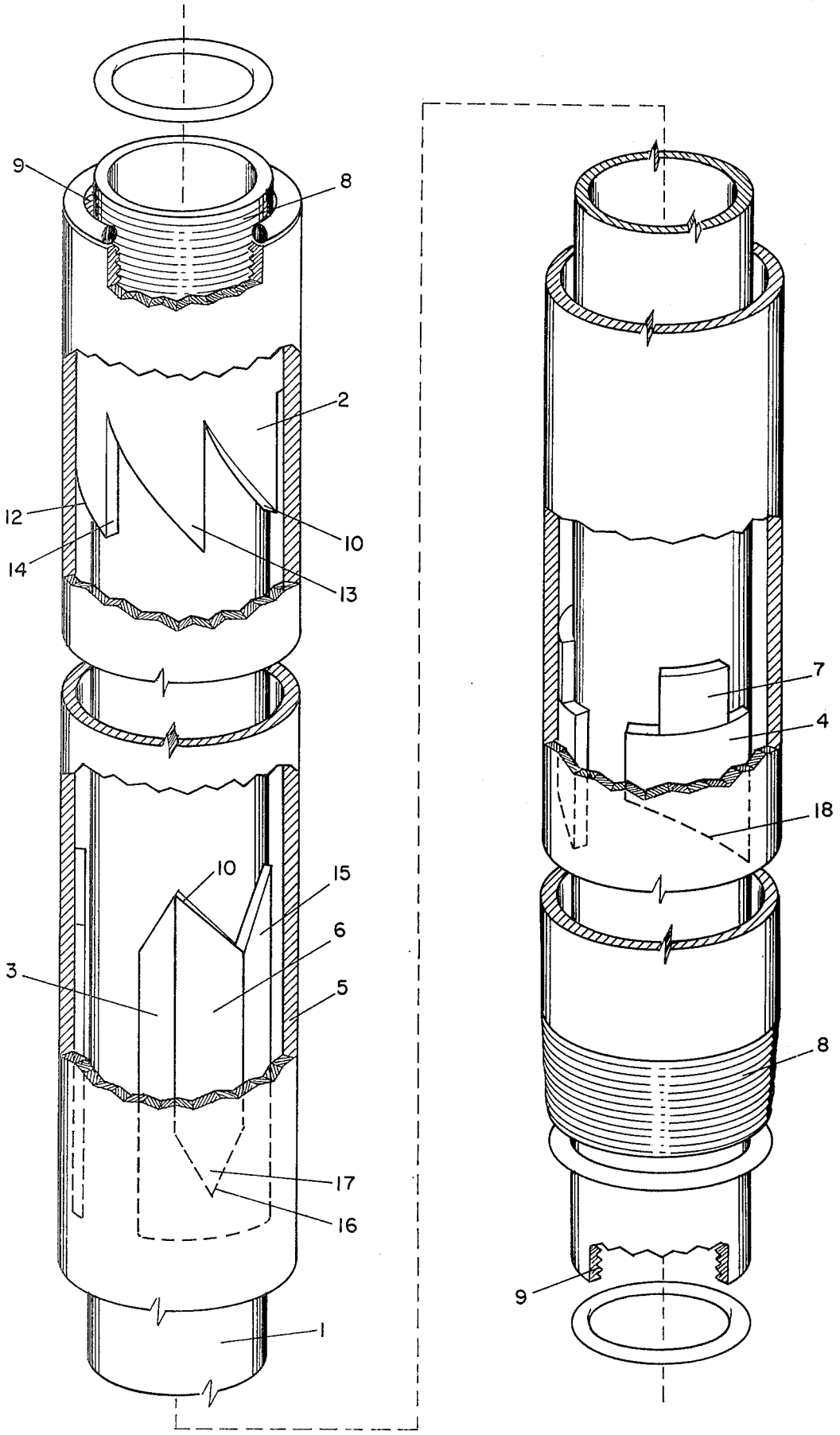
9
8
2
12
10
14
13
7
4
18
10
15
6
3
5
8
17
16
9
1

INDEXING TOOL FOR USE IN EARTH BOREHOLE DRILLING AND TESTING

DESCRIPTION OF PRIOR ART

1. Field of the Invention

This invention relates generally to earth borehole drilling apparatus, and more particularly to means for indexing tools or other apparatus with respect to the well string.

2. Prior Art

In earth bore drilling, indexing has been accomplished in a manner similar to the present invention for limited purposes. SHILLANDER, U.S. Pat. No. 3,578,078 illustrates a two position indexing means whereby the mandrel is seated for drilling or indexed while packer is compressed. However, SHILLANDER is limited in the respect that the well string is not fully rotatable independent of the indexing means, nor is the vertical travel adequate for a variety of purposes. J. LYNES, U.S. Pat. No. 3,233,676 described an indexing means similar to SHILLANDER with similar limitations; however, the load carrying area of the present design is increased from a total of ninety degrees to one hundred twenty degrees measured from the longitudinal axis of the invention, and further enhanced by multiple sets of blocks and seats.

SUMMARY

The invention provides an indexing means much less subject to jamming and much more versatile than presently known mechanisms. Utilizing an ability to make the indexing mandrel free-wheeling with respect to the indexing sleeve would permit the use of rotary motion available in the well string to operate valves or other devices in the drilling tool itself or otherwise positioned in well string; and providing a capability to use the vertical motion of the well string relative to the drilling tool would permit the actuation of a pumping device in the well string, all of which would facilitate testing while drilling of the well. It is therefore, an object of this invention to provide these capabilities and to provide an indexing device which is adaptable for use whether the invention is used in tension or compression.

BRIEF DESCRIPTION OF THE DRAWINGS

FIG. 3 shows the mandrel and tubular body concentrically disposed.

DESCRIPTION OF THE PREFERRED EMBODIMENT

Figure 1:
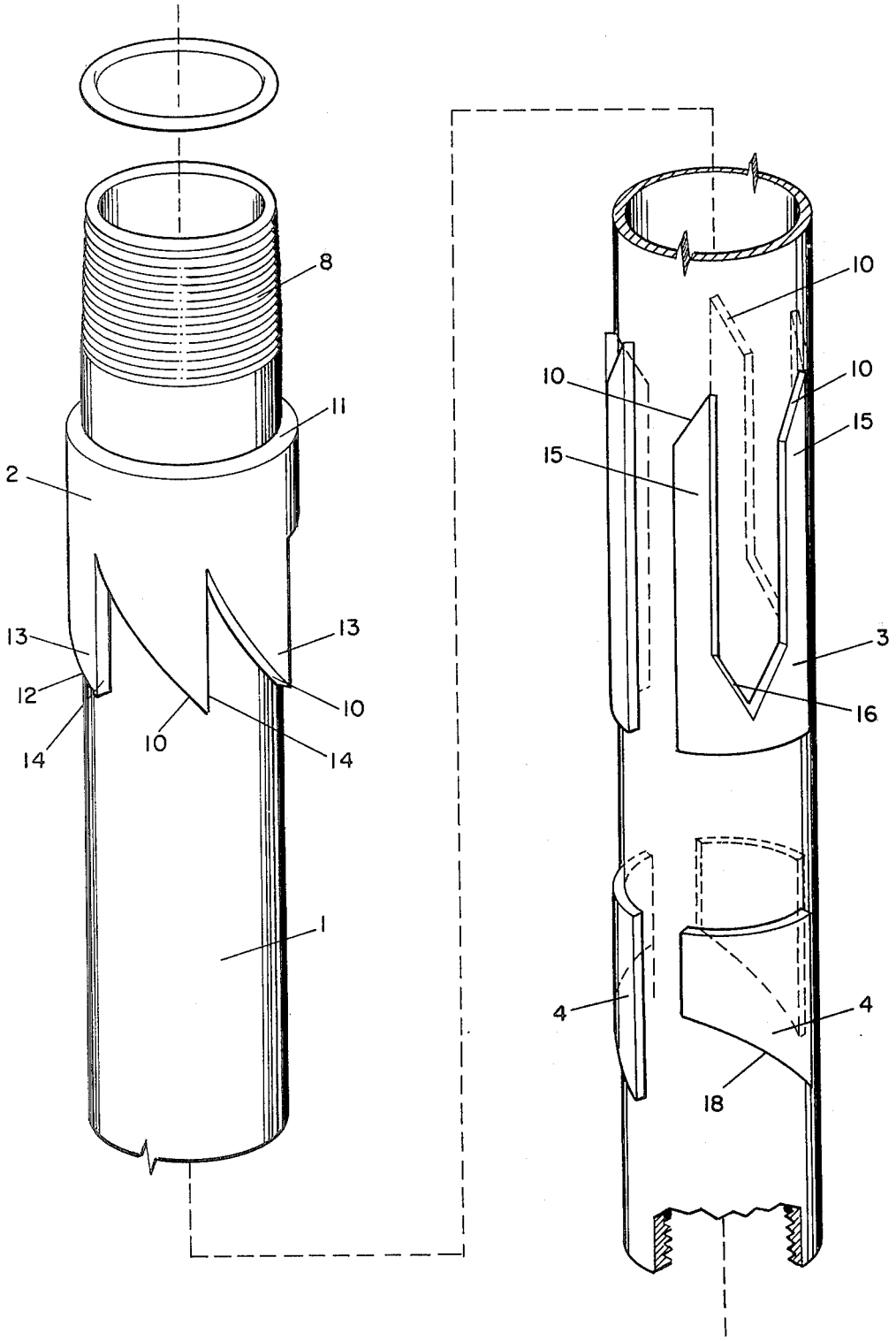
FIG. 1 shows the inner mandrel of the indexing tool.
Figure 2:
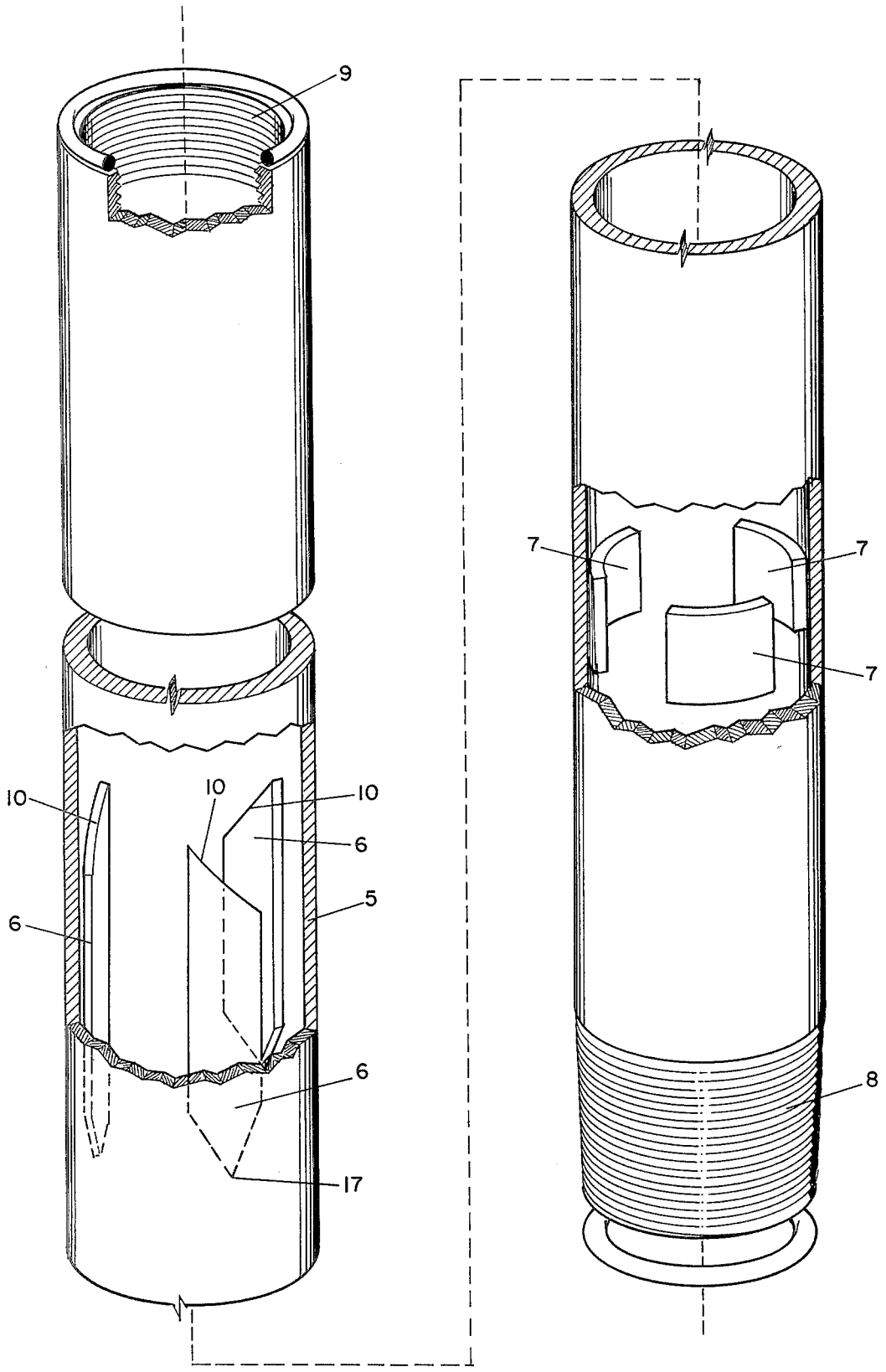
FIG. 2 shows the outer tubular body of the indexing tool.

FIG. 1 shows the invention to have a mandrel 1 with an indexing sleeve 2, a plurality of indexing splines 3, a plurality of seats 4, and the invention as shown in FIG. 2 to have a tubular body 5 with a plurality of lands 6 and blocks 7. The mandrel 1 is generally cylindrical in shape having a male threaded end 8 and a female threaded end 9. The mandrel 1 is appropriately fitted and equipped with seal grooves and seals for mating with other parts of the well string such as floater barrels and extension barrels. The mandrel 1 has an outside diameter sufficient to be slideably accepted by the tubular body 5. Adjacent to the female end 9 of the mandrel 1, the rigidly affixed to the mandrel 1 is the indexing sleeve 2. The indexing sleeve 2, shown in FIG. 1 has an inside diameter approximately the same as the outside diameter of the mandrel 1, and a wall thickness sufficient so the cam surfaces 10 may be formed on one end. The indexing sleeve 2 may be rigidly affixed to the mandrel 1 in any standard manner such as integrally formed therwith. The indexing sleeve 2 has two ends, one being a plain smooth end 11, the other being a cam end 12 having cam teeth 13. One edge of each cam tooth 13 has a longitudinal edge 14, which is parallel to the longitudinal axis of the mandrel 1. The other edge of each cam tooth 13 is the cam surface 10. At the points of intersection, the angle between the cam surfaces 10 and the longitudinal edge 14 is thirty degrees and the cam teeth 13 are sized to form six evenly spaced cam teeth 13 around the edge of the indexing sleeve 2. Disposed evenly around the outside of the mandrel 1 at the approximate mid-length of the mandrel 1 are the indexing splines 3. The indexing splines 3 are generally U shaped, each indexing spline 3 having two cam fingers 15 and a bottom 16. The indexing splines 3 have the same thickness as the indexing sleeve 2. Each cam fingers 15 has a width equal to twenty degrees, the angle being from the longitudinal axis of the mandrel 1 radially to the surface of the mandrel 1 measured on the surface of the mandrel 1; and the space between any two adjacent cam fingers 15 is forty degrees similarly measured. The U of the indexing splines 3 is open towards the indexing sleeve 2 so that the cam fingers 15 point towards the indexing sleeve. The ends of the cam fingers 15 have cam surfaces which, similar to the cam surface 10 on the indexing sleeve, form a thirty degree angle with the longer edge of the cam finger 15. However, the slope of all of the cam surfaces 10 on the cam fingers 15, while in the same direction with respect to each other, is in a counter direction around the mandrel 1 with respect to the cam surface 10 on the indexing sleeve 2. The bottom 16 of the indexing spline 3 on the inside of the U is shaped in a V whose sides form a thirty degree angle with the longitudinal axis of the mandrel 1 in order to slideably mate with the lands 6 of the tubular body 5. The mandrel 1 has disposed around its inner surface toward the male threaded end 8, a plurality of the seats 4. The seats 4 are of the same thickness as the indexing sleeve 2 and rigidly affixed to the surface of the mandrel 1 such as by forming integrally therewith. The seats 4 are flat and rectangular shaped upon which blocks 7 in the tubular body 5 rest providing a greater bearing surface. The seats 4 have a thirty degree cam surface on their bottom.

FIG. 2 shows the tubular body 5. The tubular body 5 is cylindrical in shape having on its surface a plurality of lands 6. Each land 6 is a elongated rectangular in cross-section ridge protruding longitudinally from the inner surface of the tubular body 5. The tubular body 5 is threaded on its end to mate with other parts of a well string and is adapted as necessary with grooves to accomodate seals. The tubular body 5 slides mateably over the mandrel 1, the inner diameter of the tubular body 5 being approximately the diameter of the indexing sleeve 2. The lands 6 have on one end a thirty degree cam surface 10, and the other end comes to an edge, formed by two thirty degree cam surfaces 10 intersecting forming a double beveled end 17 which slideably mates to the V of the bottom 16 of the indexing spline 3. Axially aligned with and adjacent to the double beveled end 17 of each land 16 is one of the blocks 7, being a rectangular protrusion from the inner surface of the tubular body 5. Each block 7 is sized to mateably rest on the seats 4, and is rigidly affixed to the tubular body 5. The width of the lands 6 and blocks 7 is forty degrees measured from the center to the surface of the mandrel 1 measured on the surface of the mandrel 1. The lands 6 are evenly spaced from each other around the mandrel 1. As shown in FIGS. 1, and 2 there are three lands 6 and three blocks 7 around the tubular body 5, and three indexing splines 3 and three seats 4 around the mandrel 1. If additional bearing surface is desired, additional seats 4 and blocks 7 can be provided as long as they are axially aligned with the lands 6 and splines 3 respectively. The blocks 7 and lands 6 slideably mate on the seats 4 and in the indexing splines 3 respectively and simultaneously. The blocks 7 and lands 6 can also slide through the spaces between the indexing splines 3 and seats 4. The indexing sleeve 2 is shown to have six teeth. The points of the cam teeth 13 on the indexing sleeve 2 are not aligned axially with the points on the cam fingers 15; on the contrary the points on the cam teeth 13 on the indexing sleeve are displaced twenty degrees circumferentially around the mandrel 1 from being axially aligned toward U of the indexing splines 3, or the space between the indexed splines 3; or in other words so that the longitudinal edge 14 of each cam tooth 13 is aligned with the center longitudinal axis of an indexing spline 3 or the longitudinal center of the space between the indexing splines 3. Thus assembled, with the mandrel 1 slideably mated in the tubular body 5, a vertical up sliding of the mandrel 1, from the position wherein the lands 6 and blocks 7 are respectively seated in the indexing splines 3 and seats 4, will cause the cam fingers 15 to contract the cam teeth 13, rotating the mandrel 1 with respect to the tubular body 5. A then vertical down sliding of the mandrel 1 will cause the cam surface on the land 6 to contact the double beveled end 17 of the land 6 rotating the mandrel 1 with respect to the tubular body 5 guiding the lands 6 and blocks 7 to and through the spaces between the indexing splines 3 and seats 4. When the vertical down movement of the mandrel 1 is continued until the lands 6 clear the seats 4 the mandrel 1 is free to turn. While the lands 6 and blocks 7 are in the spaces between the indexing splines 3 and the seats 4 a full vertical up and down motion of the mandrel 1 with respect to the mandrel 1 is possible without indexing, so long as the lands 6 do not engage the cam teeth 13, for a pumping function. Further raising the mandrel 1 will cause the cam surface 18 on the lands 6 to engage the cam teeth 13 rotating the mandrel 1 with respect to the tubular body 5; whereupon a vertical downward movement of the mandrel 1 will cause the double beveled end of the lands 6 to engage the cam fingers 15, thereby again seating the lands 6 and blocks 7 respectively in the indexing splines 3 and seats 4. In the free wheeling position, the initiation of a vertical sliding of the mandrel 1 may be such as the lands 6 are not aligned with the spaces between the seats 4 and in this event the cam surface 10 on the land 6 contacts the cam surface 18 on the external bottom of the seat 4 guiding the lands 6 and the blocks 7 through the space between the indexing splines 3 and seats 4.

The primary reason for the blocks 7 and the seats 4 in the invention is to provide more bearing surface since the device is required to sustain the considerable weight of drill collars suspended above or below the invention. It is therefore, obvious that the invention may be installed in the well string above or below drill collars, and can function either in tension or compression.

It is to be noted that as shown there are three indexing splines 3, three lands 6, and six cam teeth 13 in the invention. Using smaller cam teeth 13, narrower and more indexing splines 3 and cam fingers 15, and narrower spaces between indexings splines 3, the indexing function of the invention could be divided into more increments of rotary motion, if desired, and is contemplated by this invention.

It is further to be noted that the length of the invention is not restricted except by the amount of desired travel of the mandrel 1 with respect to the tubular body 5; and that the threading and seals and grooves used in well string components are contemplated by this invention.

It is further to be noted that the degrees mentioned herein as to size of parts or angle of cam surfaces are approximate and the minor variations thereof do not circumvent this invention.

I claim:

1. An indexing tool for use in well strings in earth borehole drilling and testing wherein the indexing tool comprises:

a mandrel having an upper end and a lower end; and said mandrel having an indexing sleeve rigidly affixed on the outer surface of the mandrel adjacent to the upper end; said indexing sleeve having a plurality of approximately thirty degree cam teeth pointing downward; and said mandrel having a plurality of indexing splines rigidly affixed on the outer surface of the mandrel at approximately the mid-length of the mandrel; said indexing splines being generally U shaped having two cam fingers and an inner bottom; each of the said cam fingers having approximately thirty degree cam surfaces in same direction; each of the said inner bottom of the indexing splines being V shaped by the intersecting to two approximately thirty degree cam surfaces; the said cam fingers pointing toward the indexing sleeve; and the same mandrel having rigidly affixed on its surface adjacement to the lower end a plurality of seats, said seats being rectangular trapeqoidal in shape and the seats being axially aligned with the indexing splines; the lower end of the lowest set of said seats each having approximately a thirty degree cam surface and the indexing splines being axially aligned with the points on the cam teeth; and a tubular body sized to slideably accept the mandrel, said tubular body having a plurality of lands and blocks rigidly affixed to the inner surface of the tubular body; said lands each having an approximate thirty degree cam surface on the upper end and a V shaped end formed by intersection of approximately thirty degree cam surfaces, said lands being sized and shaped to slideably mate with the inside of the indexing splines; and the blocks being sized and shaped to slideably mate on the seats; and the blocks are axially aligned with the lands;

wherein the seats and indexing splines are evenly spaced around the mandrel thereby providing a passage between adjacent indexing splines and between adjacent seats, and the lands and blocks are evenly spaced around the inner surface of the tubular body, and the number blocks, seats, indexing splines, and lands are all the same, the number of cam teeth is twice the number of indexing splines; and wherein the lands and seats can slideably pass through the passage; and when the lands and blocks have fully passed between the indexing splines, the mandrel may fully rotate with respect to the tubular body, and permit actuation of other attendant equipment;

and wherein the tubular body and mandrel are provided with threads, seals and grooves to adapt and mate with other parts currently used in well-strings, such that the indexing tool may be used in tension or compression.

2. The device of claim 1 wherein the number of cam teeth is six and the number of lands is three, and the number of indexing splines is three, and the number of seats is three and the number of blocks is three and the angle radially from the longitudinal axis of the mandrel subtended by the splines is approximately forty degrees and the angle radially from the longitudinal axis of the mandrel subtended by the spaces between the splines is approximately twenty degrees.

* * * * *